US007163420B2

(12) United States Patent
Montena

(10) Patent No.: US 7,163,420 B2
(45) Date of Patent: Jan. 16, 2007

(54) COMPRESSION CONNECTOR WITH INTEGRAL COUPLER

(75) Inventor: Noah Montena, Syracuse, NY (US)

(73) Assignee: John Mezzalingua Assoicates, Inc., Syracuse, NY (US)

( * ) Notice: Subject to any disclaimer, the term of this patent is extended or adjusted under 35 U.S.C. 154(b) by 0 days.

(21) Appl. No.: 11/287,412

(22) Filed: Nov. 23, 2005

(65) Prior Publication Data

US 2006/0073726 A1 Apr. 6, 2006

Related U.S. Application Data

(63) Continuation of application No. 10/771,899, filed on Feb. 4, 2004, now Pat. No. 7,029,304.

(51) Int. Cl.
*H01R 9/05* (2006.01)

(52) U.S. Cl. ..... 439/578

(58) Field of Classification Search ..... 439/620, 439/322, 579, 578, 583, 585, 320, 584
See application file for complete search history.

(56) References Cited

U.S. PATENT DOCUMENTS

| | | | |
|---|---|---|---|
| 2,258,737 | A | 10/1941 | Browne |
| 3,184,706 | A | 5/1965 | Atkins |
| 3,275,913 | A | 9/1966 | Blanchard |
| 3,355,698 | A | 11/1967 | Keller |
| 3,406,373 | A | 10/1968 | Forney, Jr. |
| 3,498,647 | A | 3/1970 | Schroder |
| 3,603,912 | A | 9/1971 | Kelly |
| 3,629,792 | A | 12/1971 | Dorrell |
| 3,671,922 | A | 6/1972 | Zerlin et al. |
| 3,845,453 | A | 10/1974 | Hemmer |
| 3,879,102 | A | 4/1975 | Horak |
| 3,915,539 | A | 10/1975 | Collins |
| 3,936,132 | A | 2/1976 | Hutter |
| 3,985,418 | A | 10/1976 | Spinner |
| 4,046,451 | A | 9/1977 | Juds et al. |
| 4,053,200 | A | 10/1977 | Pugner |
| 4,059,330 | A | 11/1977 | Shirey |
| 4,126,372 | A | 11/1978 | Hashimoto et al. |
| 4,156,554 | A | 5/1979 | Aujla |
| 4,168,921 | A | 9/1979 | Blanchard |
| 4,173,385 | A | 11/1979 | Fenn et al. |
| 4,227,765 | A | 10/1980 | Neumann et al. |
| 4,280,749 | A | 7/1981 | Hemmer |

(Continued)

FOREIGN PATENT DOCUMENTS

| | | |
|---|---|---|
| DE | 1 191 880 | 4/1954 |

(Continued)

*Primary Examiner*—Phuong Dinh
(74) *Attorney, Agent, or Firm*—Wall Marjama & Bilinski LLP

(57) ABSTRACT

A compression connector body for connecting a hardline cable to an equipment port is formed in two members coupled to each other by a coupling nut. A port-side member houses a conductive pin and associated elements, while a cable-side member is attached to the cable via a compression fit. With this arrangement, when servicing the equipment, the cable-side member and attached cable are removed from the port-side member without affecting the connection between the cable and the cable-side member. The port-side member is then disconnected from the equipment port. After servicing the equipment, the port-side member is reconnected to the equipment port, after which the cable-side member is reconnected to the port-side member, thus alleviating the need to cut and prepare a new length of cable for connection to the equipment port.

14 Claims, 6 Drawing Sheets

U.S. PATENT DOCUMENTS

| | | | |
|---|---|---|---|
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward |
| 4,408,821 | A | 10/1983 | Forney, Jr. |
| 4,444,453 | A | 4/1984 | Kirby et al. |
| 4,484,792 | A | 11/1984 | Tengler et al. |
| 4,533,191 | A | 8/1985 | Blackwood |
| 4,545,637 | A | 10/1985 | Bosshard et al. |
| 4,575,274 | A | 3/1986 | Hayward |
| 4,583,811 | A | 4/1986 | McMills |
| 4,596,435 | A | 6/1986 | Bickford |
| 4,600,263 | A | 7/1986 | DeChamp et al. |
| 4,614,390 | A | 9/1986 | Baker |
| 4,645,281 | A | 2/1987 | Burger |
| 4,648,684 | A | 3/1987 | Mattis et al. |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,684,201 | A | 8/1987 | Hutter |
| 4,691,976 | A | 9/1987 | Cowen |
| 4,717,355 | A | 1/1988 | Mattis |
| 4,738,009 | A | 4/1988 | Down |
| 4,746,305 | A | 5/1988 | Nomura |
| 4,747,786 | A | 5/1988 | Hayashi et al. |
| 4,755,152 | A | 7/1988 | Elliot et al. |
| 4,806,116 | A | 2/1989 | Ackerman |
| 4,813,886 | A | 3/1989 | Roos et al. |
| 4,834,675 | A | 5/1989 | Samchisen |
| 4,857,014 | A | 8/1989 | Alf et al. |
| 4,869,679 | A | 9/1989 | Szegda |
| 4,892,275 | A | 1/1990 | Szegda |
| 4,902,246 | A | 2/1990 | Samchisen |
| 4,906,207 | A | 3/1990 | Banning et al. |
| 4,923,412 | A | 5/1990 | Morris |
| 4,925,403 | A | 5/1990 | Zorzy |
| 4,929,188 | A | 5/1990 | Lionetto et al. |
| 4,990,104 | A | 2/1991 | Schieferly |
| 4,990,105 | A | 2/1991 | Karlovich |
| 4,990,106 | A | 2/1991 | Szegda |
| 5,002,503 | A | 3/1991 | Campbell et al. |
| 5,021,010 | A | 6/1991 | Wright |
| 5,024,606 | A | 6/1991 | Ming-Hwa |
| 5,037,328 | A | 8/1991 | Karlovich |
| 5,062,804 | A | 11/1991 | Jamet et al. |
| 5,066,248 | A | 11/1991 | Gaver |
| 5,073,129 | A | 12/1991 | Szegda |
| 5,083,943 | A | 1/1992 | Tarrant |
| 5,127,853 | A | 7/1992 | McMills et al. |
| 5,131,862 | A | 7/1992 | Gershfeld |
| 5,141,451 | A | 8/1992 | Down |
| 5,181,161 | A | 1/1993 | Hirose et al. |
| 5,195,906 | A | 3/1993 | Szegda |
| 5,205,761 | A | 4/1993 | Nilsson |
| 5,207,602 | A | 5/1993 | McMills et al. |
| 5,217,391 | A | 6/1993 | Fisher, Jr. |
| 5,217,393 | A | 6/1993 | Del Negro et al. |
| 5,269,701 | A | 12/1993 | Leibfried, Jr. |
| 5,283,853 | A | 2/1994 | Szegda |
| 5,295,864 | A | 3/1994 | Birch et al. |
| 5,316,494 | A | 5/1994 | Flanagan et al. |
| 5,338,225 | A | 8/1994 | Jacobsen et al. |
| 5,342,218 | A | 8/1994 | McMills et al. |
| 5,371,819 | A | 12/1994 | Szegda |
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,494,454 | A | 2/1996 | Johnsen |
| 5,499,934 | A | 3/1996 | Jacobsen et al. |
| 5,501,616 | A | 3/1996 | Holliday |
| 5,525,076 | A | 6/1996 | Down |
| 5,542,861 | A | 8/1996 | Anhalt et al. |
| 5,548,088 | A | 8/1996 | Gray et al. |
| 5,571,028 | A | 11/1996 | Szegda |
| 5,598,132 | A | 1/1997 | Stabile |
| 5,607,325 | A | 3/1997 | Toma |
| 5,632,651 | A | 5/1997 | Szegda |
| 5,651,699 | A | 7/1997 | Holliday |
| 5,667,405 | A | 9/1997 | Holliday |
| 5,863,220 | A | 1/1999 | Holliday |
| 6,032,358 | A | 3/2000 | Wild |
| 6,511,137 | B1 | 1/2003 | Gerdes |
| 6,802,738 | B1 | 10/2004 | Henningsen |
| 2005/0032422 | A1 | 2/2005 | Montena et al. |

FOREIGN PATENT DOCUMENTS

| | | |
|---|---|---|
| EP | 0 265 276 | 4/1988 |
| GB | 1087 228 | 10/1967 |
| GB | 1270 846 | 4/1972 |
| GB | 2019 665 | 10/1979 |
| GB | 2079 549 A | 1/1982 |

COMPRESSION CONNECTOR WITH INTEGRAL COUPLER

This application is a continuation of and claims priority to U.S. application Ser. No. 10/771,899 filed Feb. 4, 2004, now U.S. Pat. No. 7,029,304 which is incorporated herein by reference.

FIELD OF THE INVENTION

This invention relates generally to the field of coaxial cable connectors, and more particularly to a compression coupler connector used with hard-line coaxial cables.

BACKGROUND OF THE INVENTION

Coaxial cable is a typical transmission medium used in communications networks, such as a CATV network. The cables which make up the transmission portion of the network are typically of the "hard-line" type, while those used to distribute the signals into residences and businesses are typically "drop" connectors. The principal difference between hard-line and drop cables, apart from the size of the cables, is that hard-line cables include a rigid or semi-rigid outer conductor, typically covered with a weather protective jacket, that effectively prevents radiation leakage and protects the inner conductor and dielectric, while drop connectors include a relatively flexible outer conductor, typically braided, that permits their bending around obstacles between the transition or junction box and the location of the device to which the signal is being carried, i.e., a television, computer, and the like, but that is not as effective at preventing radiation leakage. Hard-line conductors, by contrast, generally span considerable distances along relatively straight paths, thereby virtually eliminating the need for a cable's flexibility. Due to the differences in size, material composition, and performance characteristics of hard-line and drop connectors, there are different technical considerations involved in the design of the connectors used with these types of cables.

In constructing and maintaining a network, such as a CATV network, the transmission cables are often interconnected to electrical equipment that conditions the signal being transmitted. The electrical equipment is typically housed in a box that may be located outside on a pole, or the like, or underground that is accessible through a cover. In either event, the boxes have standard ports to which the transmission cables may be connected. In order to maintain the electrical integrity of the signal, it is critical that the transmission cable be securely interconnected to the port without disrupting the ground connection of the cable. This requires a skilled technician to effect the interconnection.

Currently, when using a commercially available three piece connector, it is not practical to secure the connector on the outer conductor of the cable prior to securing the front and back portions of the connector to one another. To do so would prevent the portion secured to the cable from turning freely, thus preventing it being easily threaded onto the portion secured in the line equipment (taps, amplifiers, etc.). Instead, the installer is required to hold the cable firmly butted in the connector while tightening the two portions of the connector together; otherwise, there is the possibility of the center conductor seizure mechanism securing the center conductor in the wrong position (leading to inadequate cable retention and electrical connection). Having to hold the cable in place, while also having to manipulate two wrenches, can be inconvenient. In addition, it is not possible to disconnect the cable from the line equipment without first releasing the cable from the connector, thus breaking what might otherwise have been a good connection in order to perform service or testing. Often, in order to ensure a good connection when reinstalled, it is standard practice to cut and re-prepare the cable, which eventually shortens the cable to the point where a section of additional cable needs to be spliced or connected in.

SUMMARY OF THE INVENTION

Briefly stated, a compression connector body for connecting a hardline cable to an equipment port is formed in two members coupled to each other by a coupling nut. A port-side member houses a conductive pin and associated elements, while a cable-side member is attached to the cable via a compression fit. With this arrangement, when servicing the equipment, the cable-side member and attached cable are removed from the port-side member without affecting the connection between the cable and the cable-side member. The port-side member is then disconnected from the equipment port. After servicing the equipment, the port-side member is reconnected to the equipment port, after which the cable-side member is reconnected to the port-side member, thus alleviating the need to cut and prepare a new length of cable for connection to the equipment port.

According to an embodiment of the invention, a cable connector includes a front body adapted to connect to an equipment port; a back body adapted to receive a prepared end of a hardline coaxial cable; a coupler nut retained on the back body which screws into the front body; a conductive pin retained in the front body by an insulator, the conductive pin including a front end for connecting to the equipment port and a back end, wherein the back end includes a collet for connecting to and retaining a center conductor of the cable; a mandrel retained in the back body; means for connecting the cable to the back body; a shoulder formed in a front end of the back body; and a ridge on an inside of the coupler nut, wherein the coupler nut is retained on the back body between the shoulder of the back body and a shoulder of the mandrel.

According to an embodiment of the invention, a method of constructing a cable connector includes the steps of (a) providing a front body adapted to connect to an equipment port; (b) adapting a back body to receive a prepared end of a hardline coaxial cable; (c) retaining a coupler nut retained on the back body which screws into the front body; (d) retaining a conductive pin in the front body by an insulator, the conductive pin including a front end for connecting to the equipment port and a back end, wherein the back end includes a collet for connecting to and retaining a center conductor of the cable; (e) retaining a mandrel in the back body; (f) connecting the cable to the back body; (g) forming a shoulder in a front end of the back body; (h) forming a ridge on an inside of the coupler nut; and (i) retaining the coupler nut on the back body between the shoulder of the back body and a shoulder of the mandrel.

DETAILED DESCRIPTION OF THE PREFERRED EMBODIMENT

Figure 1:
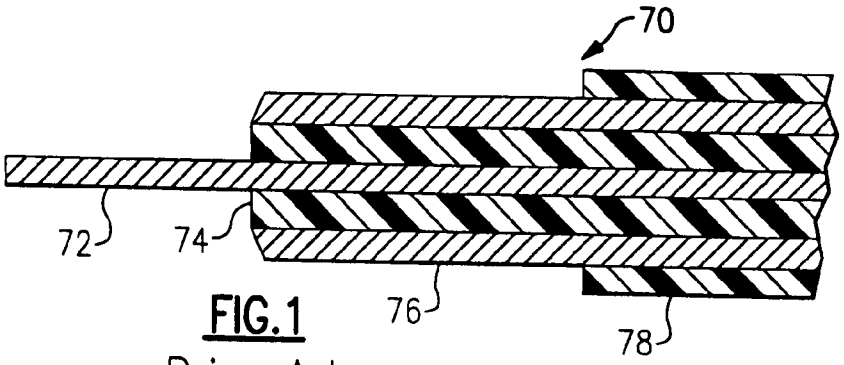
FIG.1 Prior Art
FIG. 1 shows a cross-sectional view of a coaxial cable.

Referring to FIG. 1, a cross-section of a coaxial cable 70 is shown. A center conductor 72 is surrounded by a dielectric 74 which in turn is surrounded by a ground sheath 76. These layers are then surrounded by an outer coating 78. Center conductor 72 and ground sheath 76 must be electrically conductive, while dielectric 74 must be an electrical insulator. Cable 70 is shown in a "prepared" configuration, with center conductor 72 extending from dielectric 74 and ground sheath 76, and outer coating 78 pulled back from the other layers.

Figure 2:
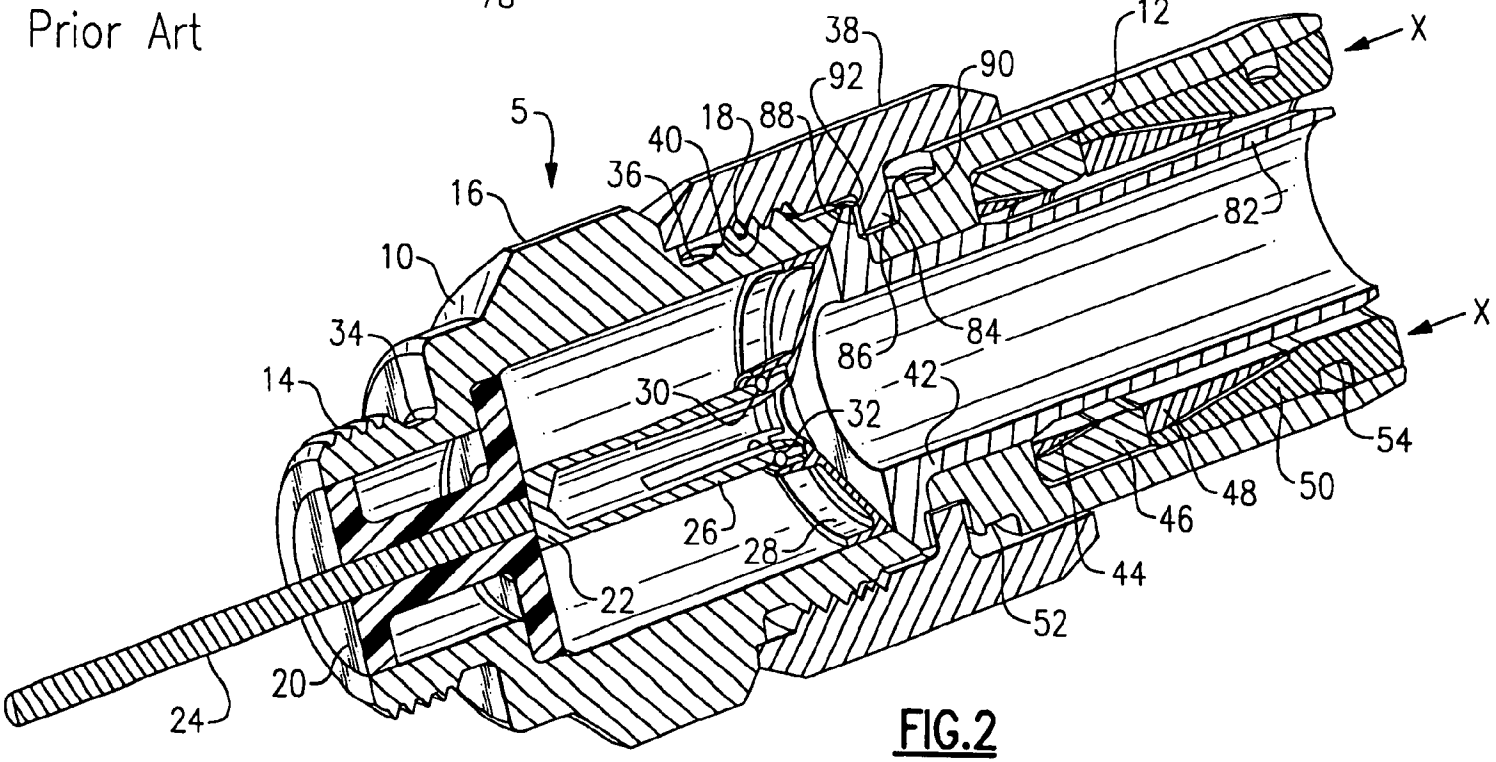
FIG. 2 shows a cutaway perspective view of an embodiment of the present invention.
Figure 3:
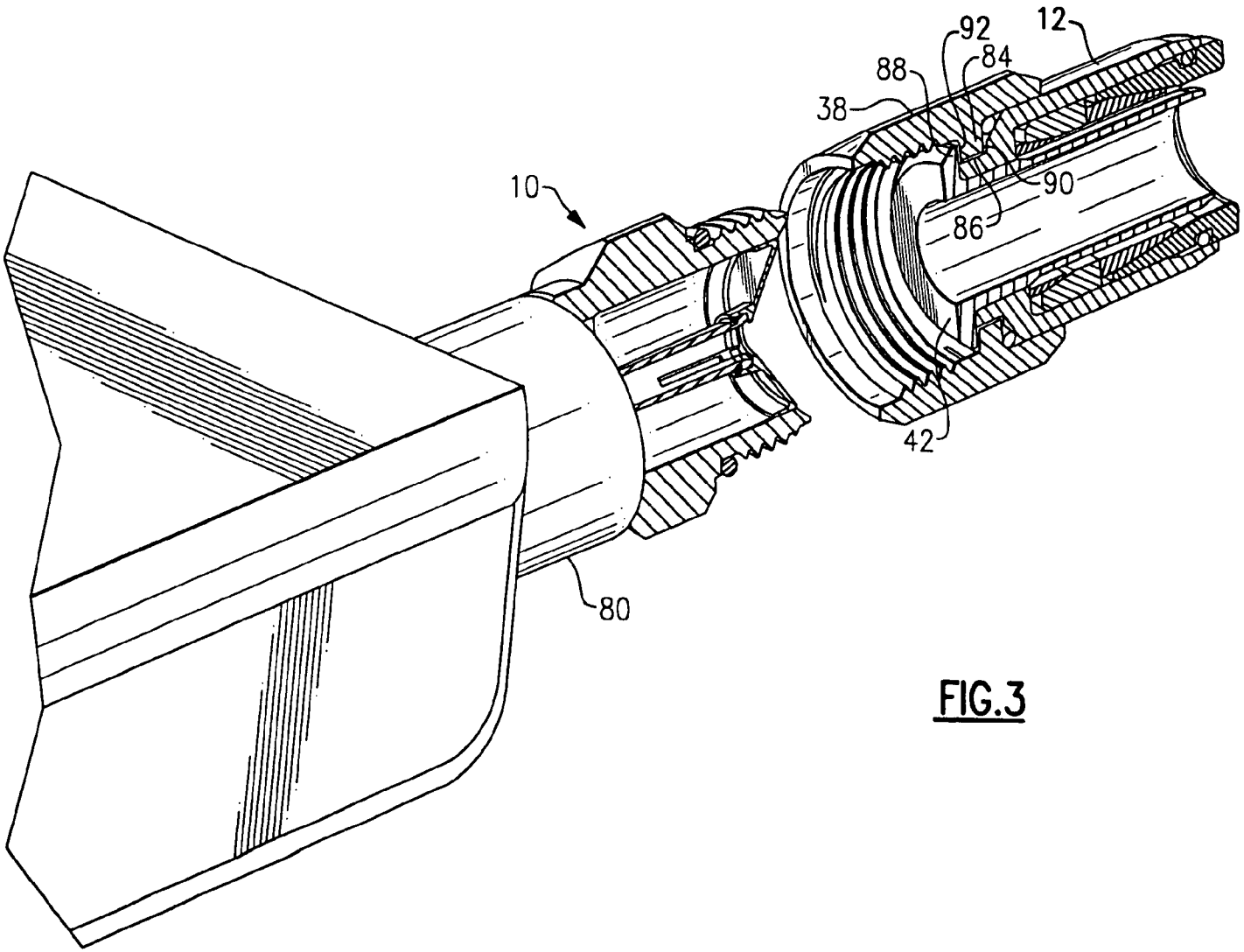
FIG. 3 shows a cutaway perspective view of the embodiment of FIG. 2 depicting a stage in connecting a coaxial cable to an equipment port.

Referring to FIG. 2, an embodiment of a coaxial cable connector 5 is shown. A front body 10 interconnects with a back body 12 via a coupler nut 38. Front body 10 includes a plurality of threads 14 which screw connector 5 to an equipment port 80 (FIG. 3). Front body 10 further includes an annular groove 34 which holds an O-ring (not shown) which seals front body 10 to equipment port 80 when connector 5 is installed, in addition to an annular groove 36 for an O-ring (not shown). Front body 10 also includes a plurality of external threads 18. Front body 10 contains a contact insulator 20 which insulates a pin portion 24 of a contact 22 from accidental grounding. Contact 22 includes a collet portion 26 which seizes and holds center conductor 72 of coaxial cable 70. A guide 28 for center conductor 72 preferably fits over a ring 30 which lies in an annular groove 32 in collet portion 26. Ring 30 contributes to the spring force of collet portion 26 which seizes and holds center conductor 72 when center conductor 72 is inserted into collet portion 26. Ring 30 is preferably a "C-clip" such as the VH & VS Light Duty Series of retaining rings, the FH & FS/FHE & FSE Series Snap Rings, or the Special Spiral Retaining Rings with special ends, all of which are manufactured by Smedley Steel Company (www.smalley.com).

Back body 12 contains a mandrel 42, which is optionally integral with guide 28. Between a portion 82 of mandrel 42 and back body 12 are various elements of a compression fitting, i.e., RFI seal 44, ramp 46, clamp seal 48, compression ring 50, and annular groove 54 for an O-ring (not shown), which are described in detail in U.S. patent application Ser. No. 10/686,204 filed on Oct. 15, 2003 and entitled APPARATUS FOR MAKING PERMANENT HARDLINE CONNECTION, incorporated herein by reference. Back body 12 includes an annular groove 52 for an O-ring (not shown). When cable 70 is connected to back body 12 of connector 5, portion 82 of mandrel 42 fits between ground sheath 76 and dielectric 74 so that the elements of the compression fitting clamp onto ground sheath 76 when an axial force X is applied as indicated to the compression fitting. Although connector 5 is intended for use with a permanent compression fitting, use with a threaded fitting or crimp-style fitting is also possible to provide similar advantages.

Coupler nut 38 includes a plurality of internal threads 40 which interface with external threads 18 of front body 10. A ridge 84 of coupler nut 38 fits within an annular channel 86 formed by a mandrel shoulder 88 and a back body shoulder 90. A plastic thrust bearing 92 disposed between ridge 84 and shoulder 88 permits coupler nut 38 to rotate onto front body 10 when being tightened or loosened. Coupler nut 38 is a free wheeling coupler nut in that it turns without hindrance when threads 40 are not interacting with threads 18.

Figure 4:
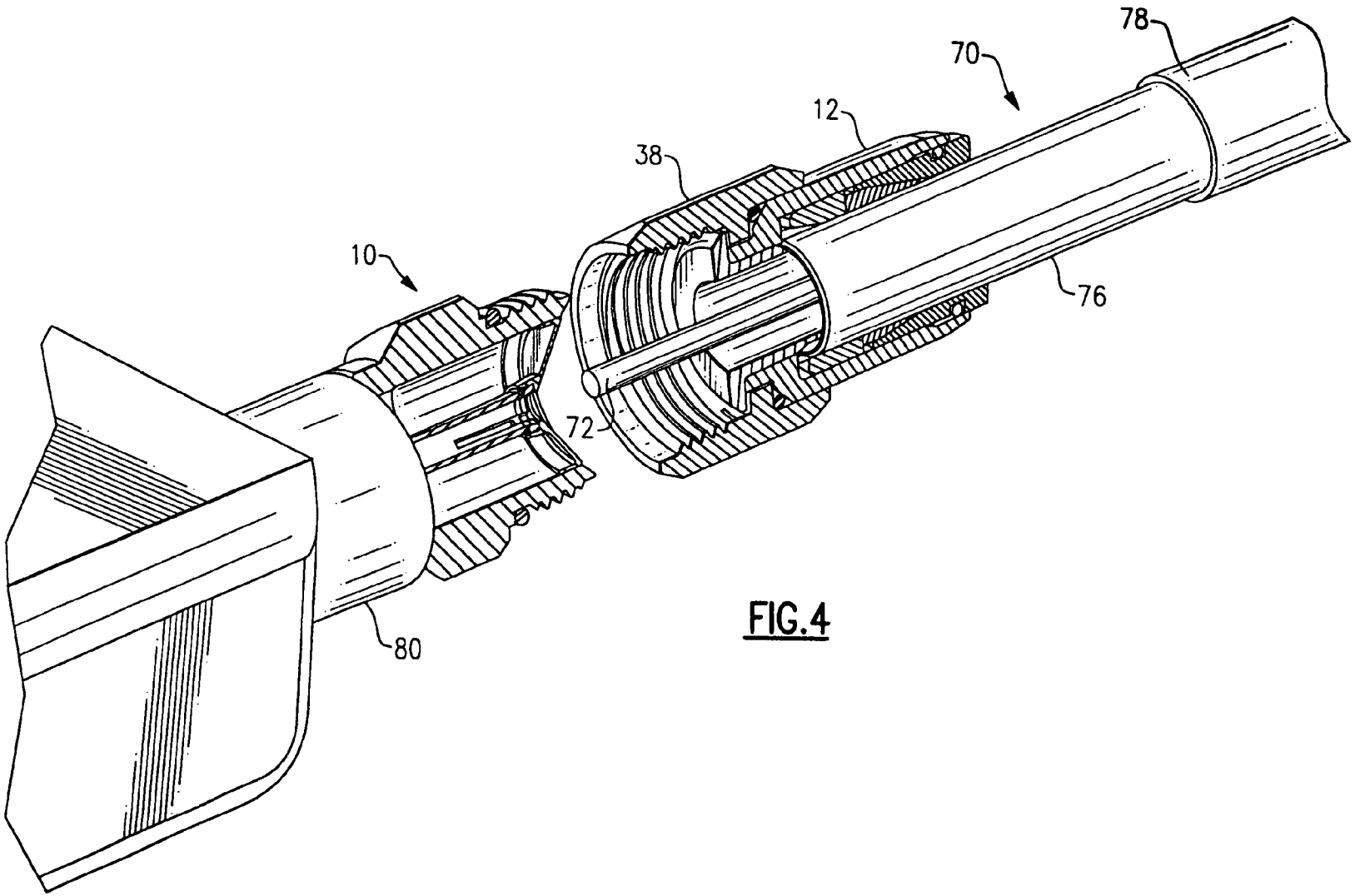
FIG. 4 shows a cutaway perspective view of the embodiment of FIG. 2 depicting a stage in connecting a coaxial cable to an equipment port.
Figure 5:
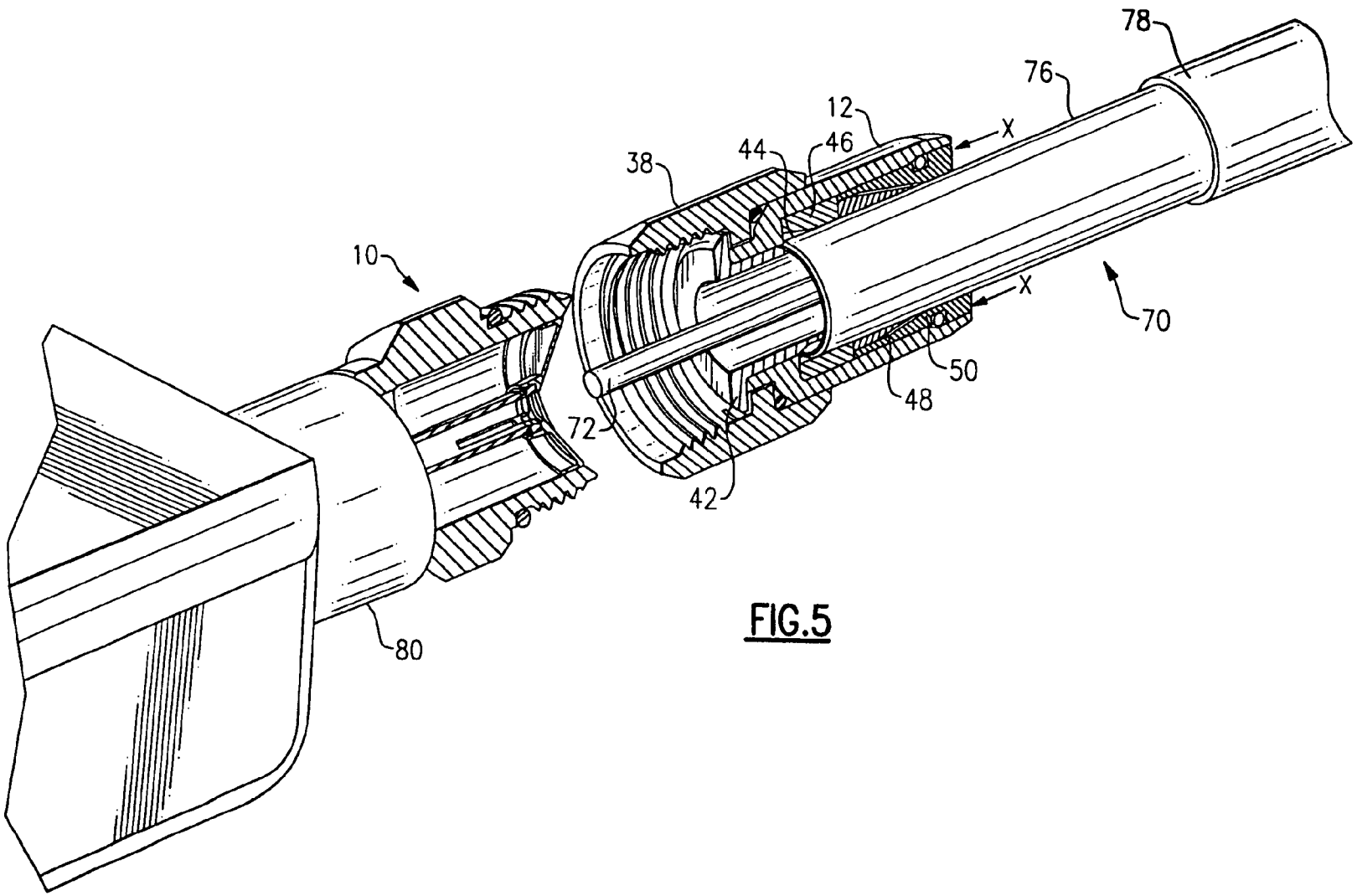
FIG. 5 shows a cutaway perspective view of the embodiment of FIG. 2 depicting a stage in connecting a coaxial cable to an equipment port.
Figure 6:
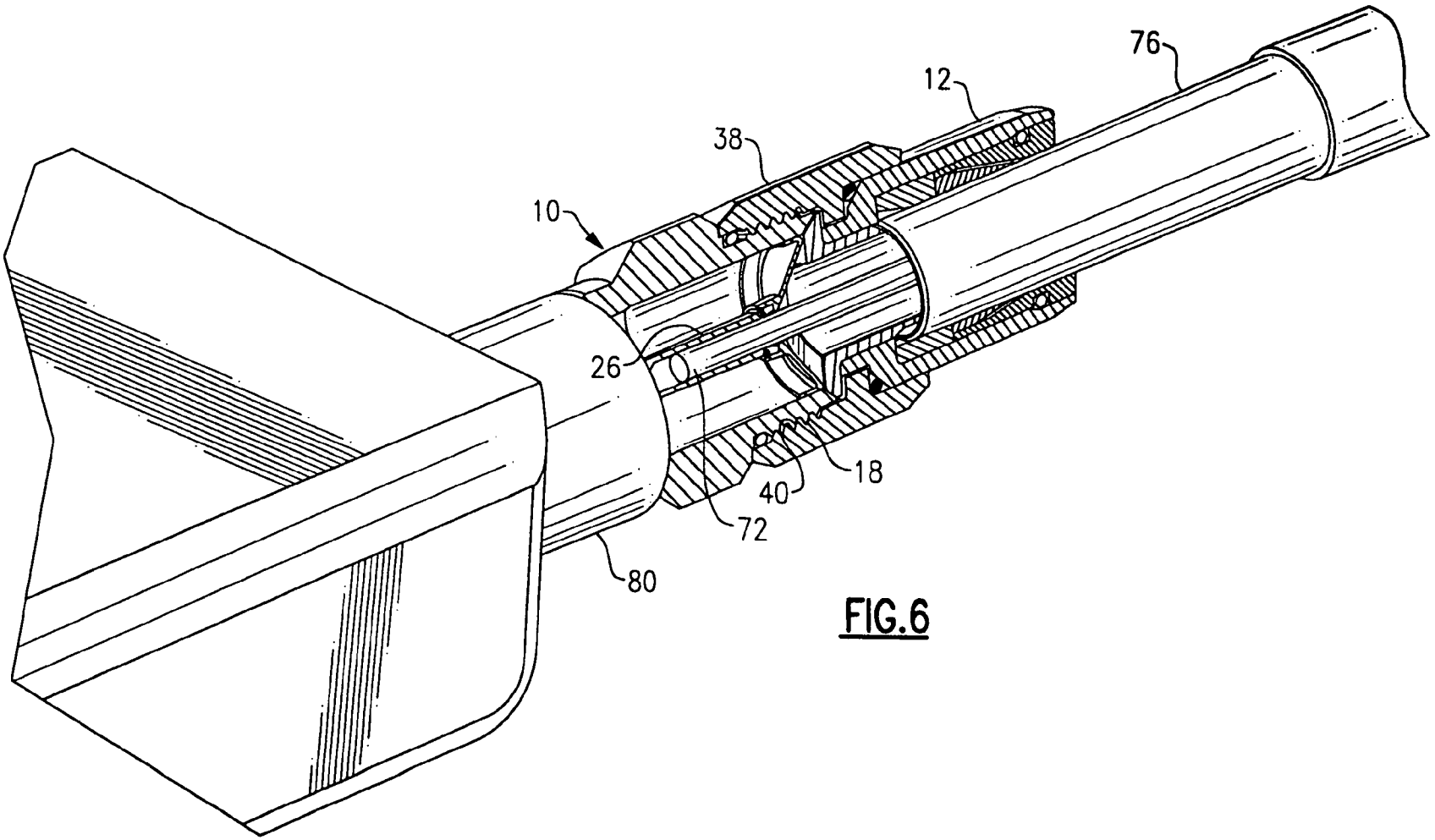
FIG. 6 shows a cutaway perspective view of the embodiment of FIG. 2 depicting a stage in connecting a coaxial cable to an equipment port.
Figure 7:
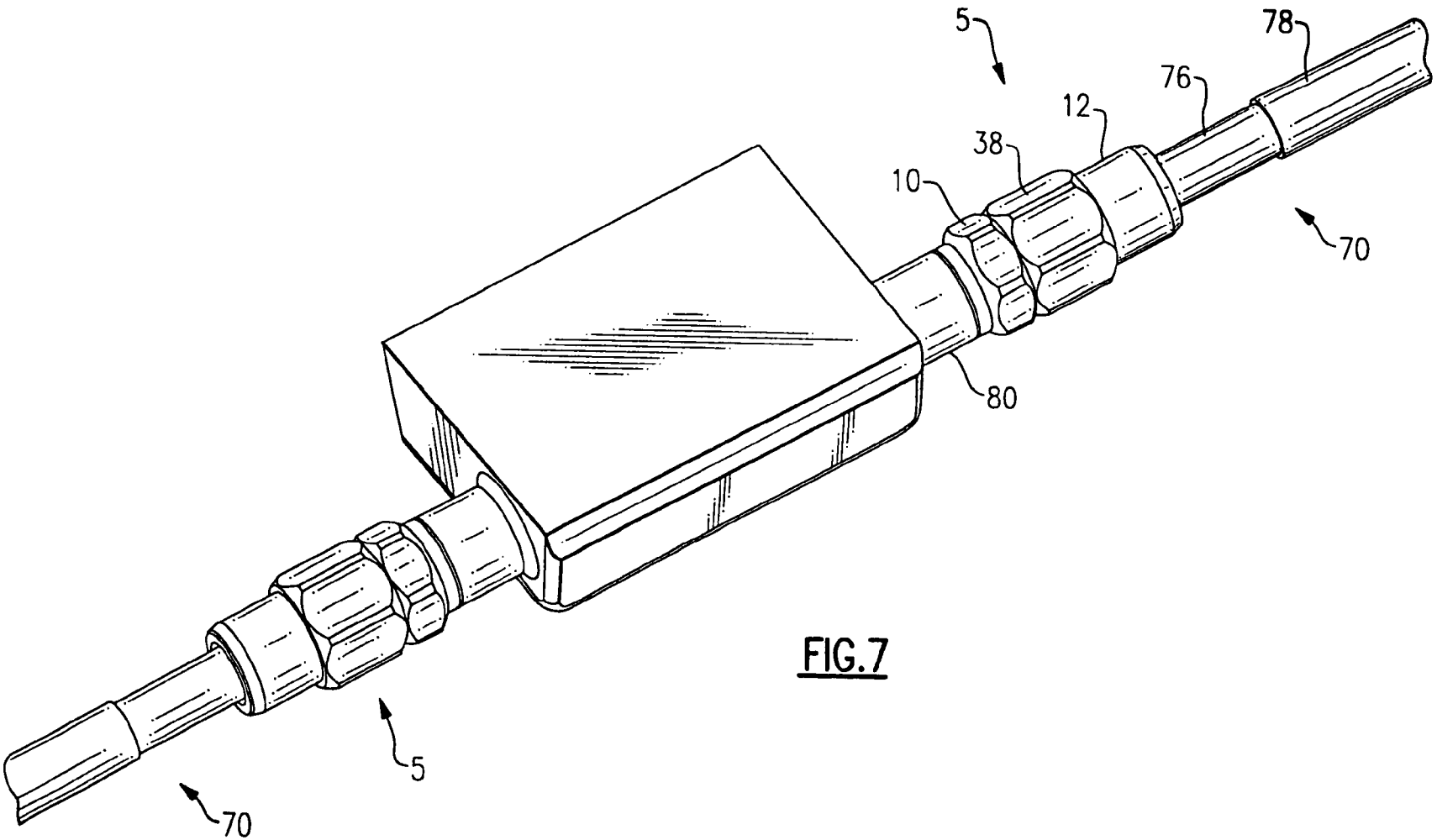
FIG. 7 shows a perspective view of the embodiment of FIG. 2 connecting a coaxial cable to an equipment port.

Referring to FIGS. 3–7, coaxial cable 70 is connected to equipment port 80 as follows. As shown in FIG. 3, front body 10 is screwed into equipment port 80 or other connection. Note that coupler nut 38 is already installed on back body 12. As shown in FIG. 4, a prepared end of cable 70 is inserted through the rear of back body 12. As shown in FIG. 5, cable 70 is connected to back body 12 of connector 5 by applying compressive axial force X as indicated. Then, as shown in FIG. 6, center conductor 72 is inserted into collet portion 26 where the spring action of collet portion 26 helps to secure center conductor 72 to contact 22, after which coupler nut 38 is screwed onto front body 10. As shown in FIG. 7, cable 70 is now connected to equipment port 80 by connector 5. The connection can be broken easily for equipment service without removing connector 5 from cable 70 simply by unscrewing coupler nut 38 from front body 10. After servicing the equipment, screwing coupler nut 38 onto front body 10 reconnects cable 70 to equipment port 80. Because connector 5 does not require heat shrink, the use and re-use of connector 5 is advantageous in that there is no time spent in removing the heat shrink, there is no time spent trying to release cable 70 from back body 12, and there are fewer service calls resulting from the ingress/egress moisture damage associated with man-handling cable using ordinary connectors. The number of service call backs is also educed because the RF shielding, the environmental seal, and the grip on the cable are never degraded by multiple uses. Once the ground connection is established upon initial installation, it is never broken again.

Connector 5 is intended for use with bonded cables only. In order to provide the benefits of damage-free multiple disconnects, the connector does not "seize" the center conductor in the same manner as traditional hardline connectors. Electrical contact is firm and reliable, with insertion loss meeting SCTE specifications, but axial movement of the center conductor in and out of the terminal is allowed without the possibility of buckling or elongation of the center conductor. Using bonded cable prevents the possibility of "suck out" in cold weather. What little independent motion of the center conductor that may occur is safeguarded by overlap of the contact point and the end of the center conductor.

The uniqueness of the coupler design for hardline connectors lies in the connector's ability to remain completely attached to the outer conductor of the cable, while still allowing disconnection of the cable and connector from an equipment port. It does this in much the same manner as a typical connector for drop (flexible) coaxial cable. However, instead of simply providing a feed-through connection where the cable passes through the connector into the equipment, the hardline coupler connector uses an integral interface adapter which connects between the port and the cable. This portion of the connector remains in the equipment port when the connector is separated. In addition, there are substantial differences between the drop cable where typical drop connectors are used, and the hard line cable where the coupler would be used, in construction, use, and preparation.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A hardline coaxial cable connector comprising:

a front body member having a first end and a second end, said first end adapted to connect to an equipment port and said second end having external threads;

a back body member separable from the front body member, said back body member having a first end and a second end, said first end including an external shoulder and said second end housing a permanent compression fitting;

a coupler nut having a first end and an internal ridge, wherein said coupler nut is retained on said back body member at said shoulder of said back body member and said first end having internal threads which mate with the external threads on said second end of said front body member;

whereby the front body member can be detachable and re-attachable from the back body member without adversely affecting the permanent compression fitting.

2. A hardline coaxial cable connector according to claim 1, wherein said back body member has mounted therein a mandrel having a first end.

3. A hardline coaxial cable connector according to claim 2, wherein said first end of said mandrel includes a shoulder adapted to cooperate with said internal ridge on the coupler nut to retain said coupler nut on the back body member.

4. A hardline coaxial cable connector according to claim 3, wherein said second end of said front body member is adapted to mate with one of the first end of the back body member and the first end of said mandrel.

5. A cable connector according to claim 4, wherein said second end of said front body member includes a tapered surface which mates with a complementary tapered surface at the first end of said mandrel.

6. A hardline coaxial cable connector according to claim 4, further comprising a thrust bearing disposed between said internal ridge of said coupler nut and said shoulder of said mandrel.

7. A hardline coaxial cable connector according to claim 1, wherein said front body houses a conductive pin, said conductive pin including a front end for connecting to said equipment port and a back end, wherein said back end includes a collet.

8. A hardline coaxial cable connector according to claim 7, wherein said collet includes a spring biased ring to define a mechanical interference fit.

9. A cable connector according to claim 8, further comprising a guide disposed within said front body, wherein a portion of said guide fits over said ring.

10. A hardline coaxial cable connector according to claim 3, wherein said front body houses a conductive pin, said conductive pin including a front end for connecting to said equipment port and a back end, wherein said back end includes a collet.

11. A hardline coaxial cable connector according to claim 10, wherein said collet includes a spring biased ring to define a mechanical interference fit.

12. A hardline coaxial cable connector according to claim 11, further comprising a guide disposed within said front body, wherein a portion of said guide fits over said ring.

13. A hardline coaxial connector body comprising:

a front body member having a first end adapted to mate with an equipment port, a second end with external threads, and housing a conductive pin;

a back body member having first end having an external shoulder and a second end adapted to house a permanent compression fitting;

a coupler nut including a first end having internal threads adapted to selectively engage the external threads of said front body member and an internal ridge adapted to mate with the shoulder of back body member;

whereby the front body member is detachable and re-attachable from the back body member by selective engagement of the threads of the coupler nut, said selective engagement not adversely affecting the permanent compression fitting.

14. A hardline coaxial cable connector body according to claim 13, wherein engagement of the threads of the coupler nut holds the second end of the front body member in contact with the first end of the back body member.

* * * * *